US006075488A

United States Patent [19]

Hope

[11] Patent Number: 6,075,488

[45] **Date of Patent: *Jun. 13, 2000**

[54] DUAL-BAND STUB ANTENNA

[75] Inventor: William Hope, Dalgety Bay, United Kingdom

[73] Assignee: Galtronics Ltd., Tiberias, Israel

[ * ] Notice: This patent issued on a continued prosecution application filed under 37 CFR 1.53(d), and is subject to the twenty year patent term provisions of 35 U.S.C. 154(a)(2).

[21] Appl. No.: 09/067,173

[22] Filed: Apr. 27, 1998

Related U.S. Application Data

[60] Provisional application No. 60/048,393, Jun. 3, 1997.

[30] Foreign Application Priority Data

Apr. 29, 1997 [IL] Israel ..... 120737

[51] Int. Cl.[7] ..... H01Q 1/24

[52] U.S. Cl. ..... 343/702; 343/895; 343/725

[58] Field of Search ..... 343/895, 702, 343/725, 729; H01Q 1/24

[56] References Cited

U.S. PATENT DOCUMENTS

| | | | |
|---|---|---|---|
| 5,204,684 | 4/1993 | Caudroy | 342/182 |
| 5,650,789 | 7/1997 | Elliott et al. | 343/702 |
| 5,661,496 | 8/1997 | Baek et al. | 343/702 |

FOREIGN PATENT DOCUMENTS

| | | |
|---|---|---|
| 0 613 209 | 8/1994 | European Pat. Off. . |
| 0 747 990 | 12/1996 | European Pat. Off. . |
| 0 755 091 | 1/1997 | European Pat. Off. . |
| 0 831 545 | 3/1998 | European Pat. Off. . |
| 63286008 | 11/1988 | Japan . |
| 9520018 | 9/1995 | United Kingdom . |
| WO 95/12224 | 5/1995 | WIPO . |
| WO 97/12417 | 4/1997 | WIPO . |
| WO 97/30489 | 8/1997 | WIPO . |
| WO 97/41621 | 11/1997 | WIPO . |

*Primary Examiner*—Hoanganh Le
*Attorney, Agent, or Firm*—Ladas & Parry

[57] ABSTRACT

A broadband antenna, including a centrally-positioned radiating element, a dielectric support element generally surrounding the centrally-positioned element, and a linear radiating element, which extends along at least part of the length of the centrally-positioned element and a portion of which is wound over the support element around the centrally-positioned element. The centrally-positioned element preferably includes a linear metallic radiator, and the linear radiating element preferably includes a wire, such that the portion of the wire that is wound over the support element defines a helical radiator.

10 Claims, 10 Drawing Sheets

COIL PARALLEL RESONANT FREQUENCY, $F = \frac{1}{2 \times \Pi \times \sqrt{L \times (Cs+Cc)}}$ CIRCUIT QUALITY FACTOR, $Q = \frac{2 \times \Pi \times F \times L}{r}$ r negligible CIRCUIT DYNAMIC IMPEDANCE, $Zd = \frac{L}{(Cs + Cc) \times r}$

DUAL-BAND STUB ANTENNA

This Application claims the benefit of U.S. Provisional Ser. No. 60/048,393 filed Jun. 3, 1997.

FIELD OF THE INVENTION

The present invention relates to antennas generally and more particularly to mobile telecommunications antennas.

BACKGROUND OF THE INVENTION

A great variety of telecommunications antennas are known. In the rapidly growing areas of mobile telecommunications, there do not presently exist mobile telecommunications antennas having dual frequency band capability.

Dual frequency antenna assemblies are known for other applications but are not suitable for mobile telecommunications due to their relatively high cost and complexity. Such dual frequency antenna assemblies typically include computer controlled tuning circuits, whose size renders them unsuitable for mobile telecommunications applications.

Broadband antennas for mobile telecommunications applications including a dual band helical antenna are described in applicant/assignee's published U.K. Patent Application 9520018.4.

SUMMARY OF THE INVENTION

The present invention seeks to provide a dual frequency band antenna suitable for use as a mobile telecommunications antenna.

There is thus provided in accordance with a preferred embodiment of the present invention a multiple frequency band antenna comprising multiple antenna elements having at least two frequency bands which are separated from each other by a frequency greater than the frequency at one of the two frequency bands.

There is also provided in accordance with a preferred embodiment of the present invention a multiple frequency band antenna comprising at least first and second antenna elements capacitively coupled to each other and a matching circuit coupled to the at least first and second antenna elements for providing impedance matching thereto for operation in multiple frequency bands.

In accordance with a preferred embodiment of the present invention the at least first and second antenna elements comprise at least one of coils and linear metallic radiators.

In accordance with one embodiment of the present invention, the at least first and second antenna elements both comprise helical resonators.

According to an alternative embodiment of the present invention, the at least first and second antenna elements are linear metallic radiators.

In accordance with a preferred embodiment of the present invention a helical antenna element is located at the top of a linear metallic radiator and electrically isolated therefrom.

In accordance with a preferred embodiment of the present invention, the antenna may be either a fixed antenna or a retractable antenna.

Preferably, the first frequency band is in the GSM range (950 MHz) and the second frequency band in the PCS range (1.9 Ghz). Alternatively, the first frequency band is in the AMPS range (860 MHz) and a second frequency band in the PCS range (1.9 GHz).

There is also provided in accordance with another preferred embodiment of the present invention an RF transceiver system including an RF frequency generating device, a multiple frequency band antenna, an RF antenna terminal, and an antenna frequency matching network, inclduing at least one inductor, and a plurality of capacitors, wherein the antenna frequency matching network is in communication with the RF frequency generating device and the multiple frequency band antenna, and wherein the antenna frequency matching network effects energy transfer between said RF frequency generating device and said multiple frequency band antenna.

Further in accordance with a preferred embodiment of the present invention the plurality of capacitors includes a first capacitor, and a second capacitor, wherein the capacitance of the first capacitor has a capacitance of at least ten times the capacitance of the second capacitor.

Still further in accordance with a preferred embodiment of the present invention the inductor has an inductance value which provides a reactance compensation across the RF antenna terminal to a ground plane thereby changing an electrical length of the multiple frequency band antenna connected to the the RF antenna terminal, whereby if the reflected reactance compensation is negative the the electrical length of the multiple frequency band antenna is reduced and if the reflected reactance compensation is positive the electrical length of the multiple frequency band antenna is increased.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
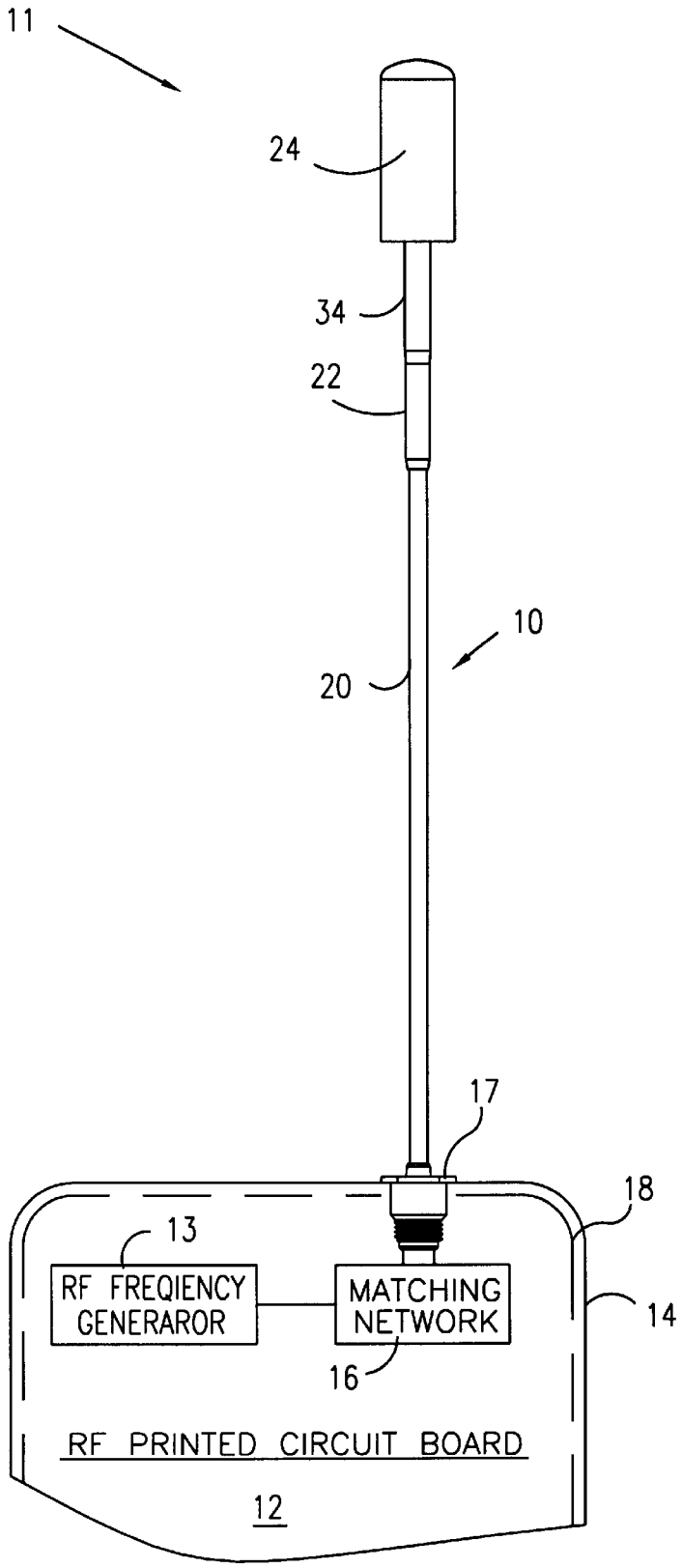
FIGS. 1A and 1B are a simplified illustrations of a dual mode antenna constructed and operative in accordance with a preferred embodiment of the present invention in respective extended and retracted operative orientations.
Figure 1B:
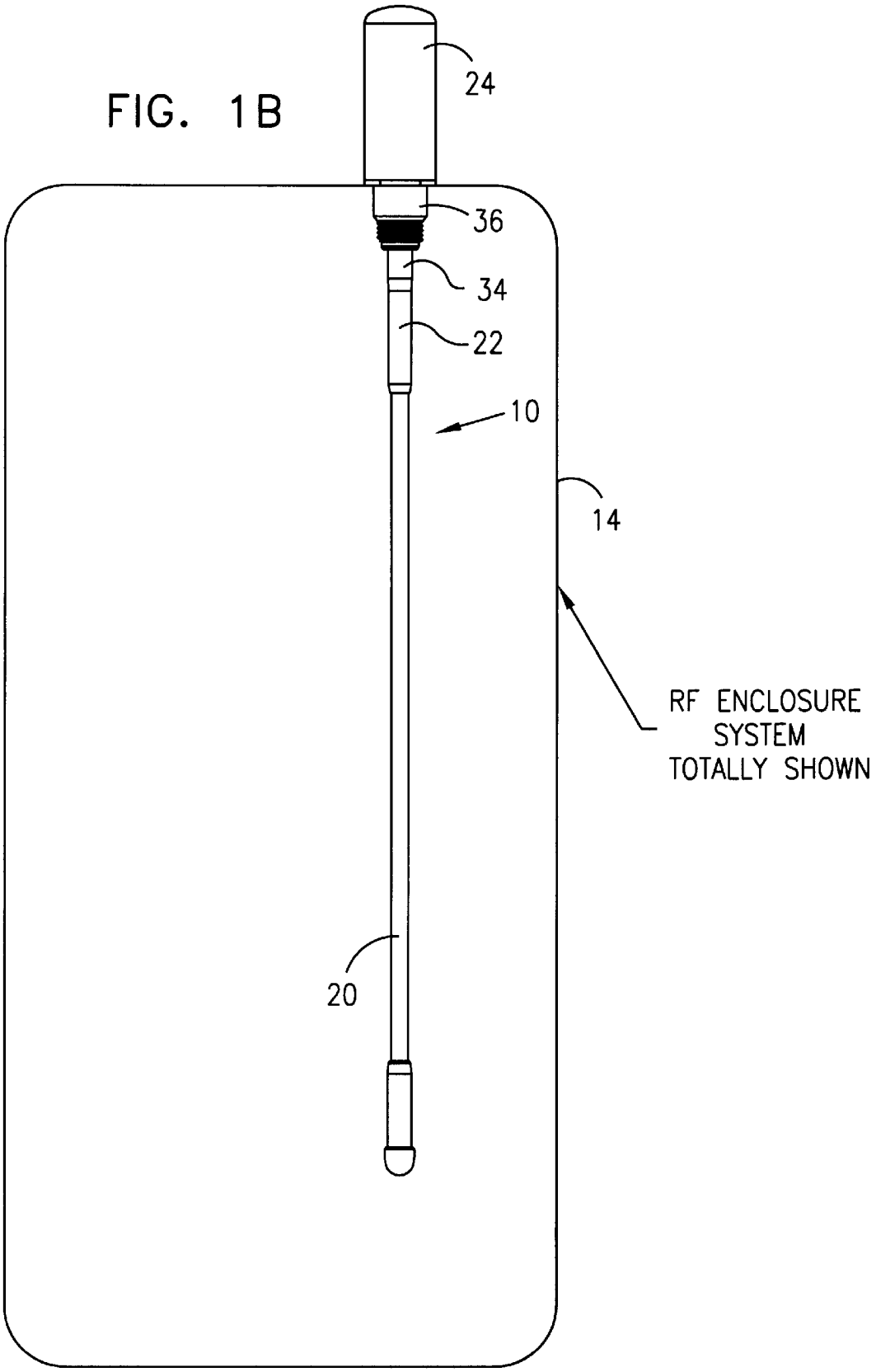
Figure 2:
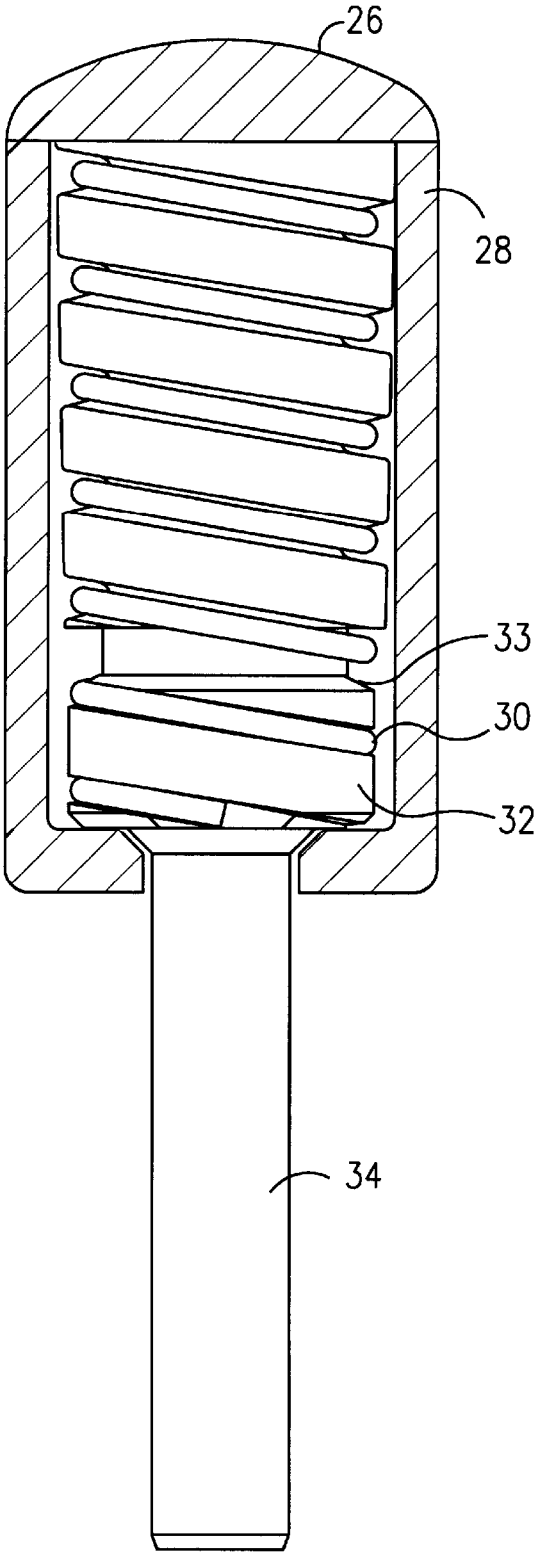
FIG. 2 is a sectional illustration of the upper helical radiating element of the antenna of FIG. 1.

Reference is now made to FIGS. 1A–3C, which illustrate a dual mode antenna 10 constructed and operative in accordance with a preferred embodiment of the present invention. FIGS. 1A and 1B show the antenna 10, which forms part of an RF transceiver device 11, mounted onto an RF printed circuit board 12 within an RF system enclosure 14 and coupled to an antenna matching network 16, having an effective ground plane area indicated by reference numeral 18. An RF frequency generator 13 is located on RF printed circuit board 12 and generates RF signals to the antenna 10 via the matching network 16. The matching network 16 is in communication with the dual mode antenna 10 via an RF antenna terminal 17. Furthermore, FIGS. 1A and 1B illustrate the antenna 10 in extended and retracted operative orientations, respectively.

In accordance with a preferred embodiment of the present invention, the antenna 10 comprises a lower radiating element 20 which is coupled via a coupling capacitor 22 to an upper radiating element 24. As seen with greater particularity in FIGS. 2 and 3A, the upper radiating element 24 is preferably constructed to have an outer cap 26 and sleeve 28, preferably formed of a dielectric material, such as plastic, covering a metal coil 30. An RF contact 34 is preferably provided which includes an upper barrel 32 with a recess 33 formed therein around which recess 33 coil 30 is wound. The coil 30 is electrically connected via RF contact 34 to coupling capacitor 22.

The coupling capacitor 22 is preferably constructed as an overmolded section, part of which is integral with the lower radiating element 20. Lower radiating element 20 is preferably constructed as a linear radiating element and is mechanically mounted onto system enclosure 14 by means of a lower connector assembly 36.

Figure 3A:
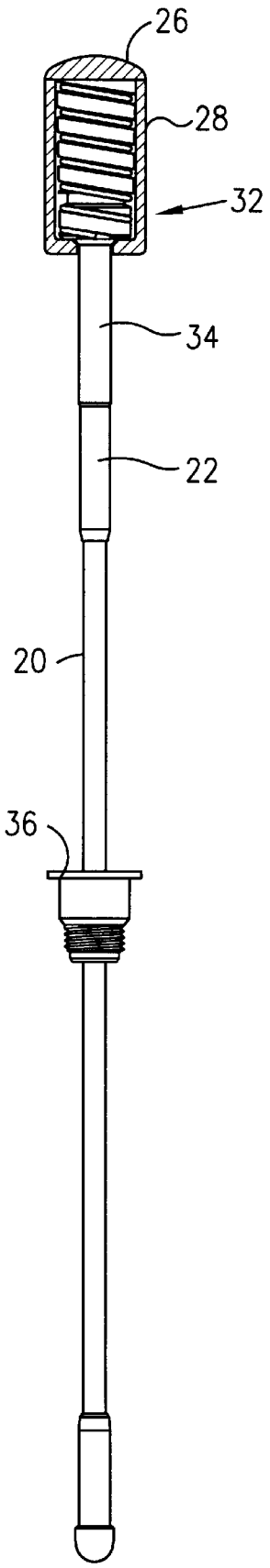
FIGS. 3A, 3B, and 3C are exploded views of the antenna of FIGS. 1 and 2.
Figure 3B:
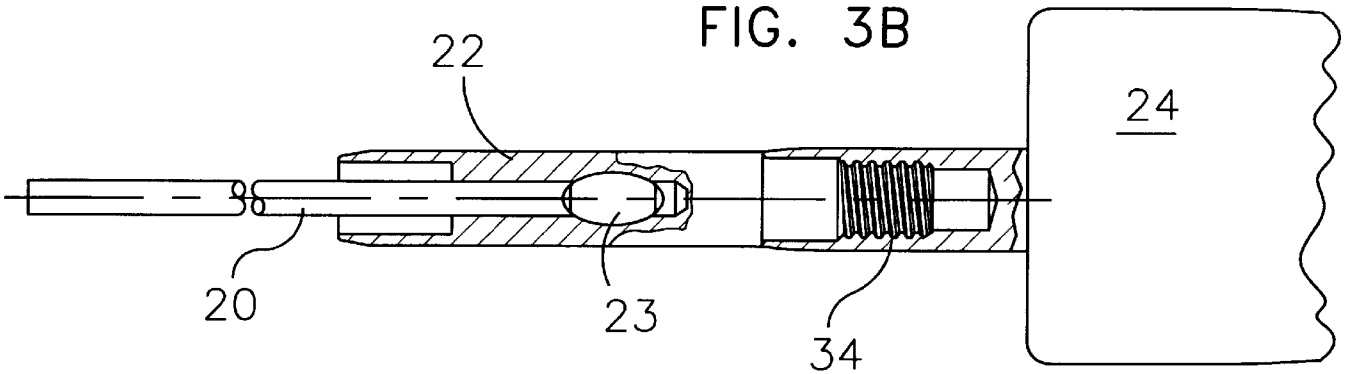
Figure 3C:
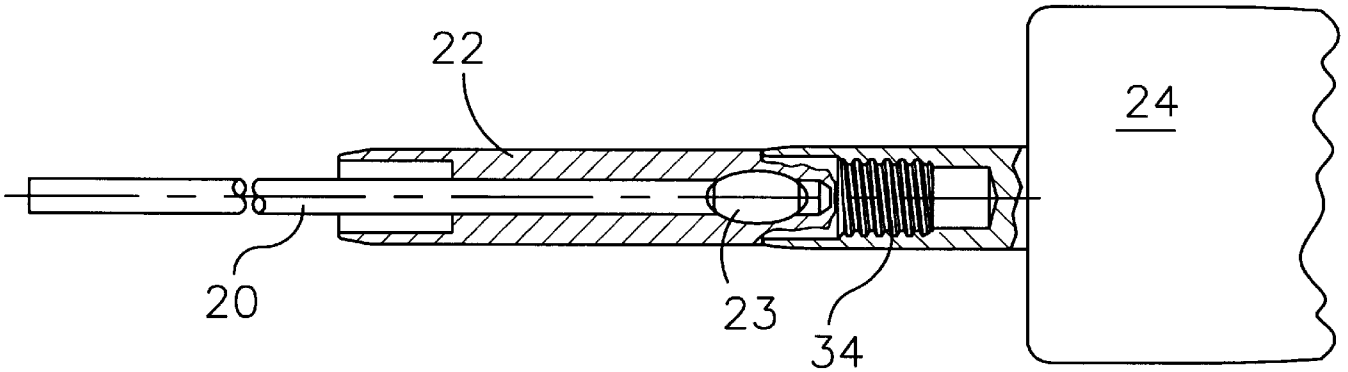

As seen with greater particularity in FIG. 3C, lower radiating element 20 preferably extends through the overmolded section 22 and into RF connector 34 to form a precise, coaxially-formed, capacitor with an accurately specified capacitance value. Alternatively, as seen with greater particularity in FIG. 3B, lower radiating element 20 may be sufficiently distant from RF contact 34 such that lower radiating element 20 does not extend into RF contact 34, as is described in U.S. Pat. No. 5,204,684, the disclosure of which is incorporated herein by reference. A crimp 23 is included in the construction of lower radiating element 20 to provide physical strength to the element 20.

In accordance with a preferred embodiment of the present invention, the upper radiating element 24 and the lower radiating element 20 have at least two distinct frequency bands which may be separated from each other by a frequency greater than the frequency at one of the two frequency bands.

In accordance with a preferred embodiment of the invention, upper radiating element 24 and lower radiating element 20 each have preferably two pre-determined center frequencies, for example, one frequency is in the (AMPS) frequency range (e.g. 860 MHz) and the other frequency is in the PCS 1900 frequency range (e.g. 1.92 GHz).

Alternatively, the present invention allows operation of the antenna 10 in other RF/Microwave bands, for example, the antenna 10 may also operate in the GSM frequency range (880 MHz to 950 MHz) and in the DCS frequency range (1.71 GHz to 1.88 GHz).

The combination of the upper and lower radiating elements 24 and 20, acting together and in association with the reactance compensation effects provided by the antenna matching network described hereinbelow with reference to FIG. 8, typically results in a dual-frequency mode of operation when antenna 10 is positioned in either the extended or retracted mode of operation in an RF and/or microwave system.

Figure 4:
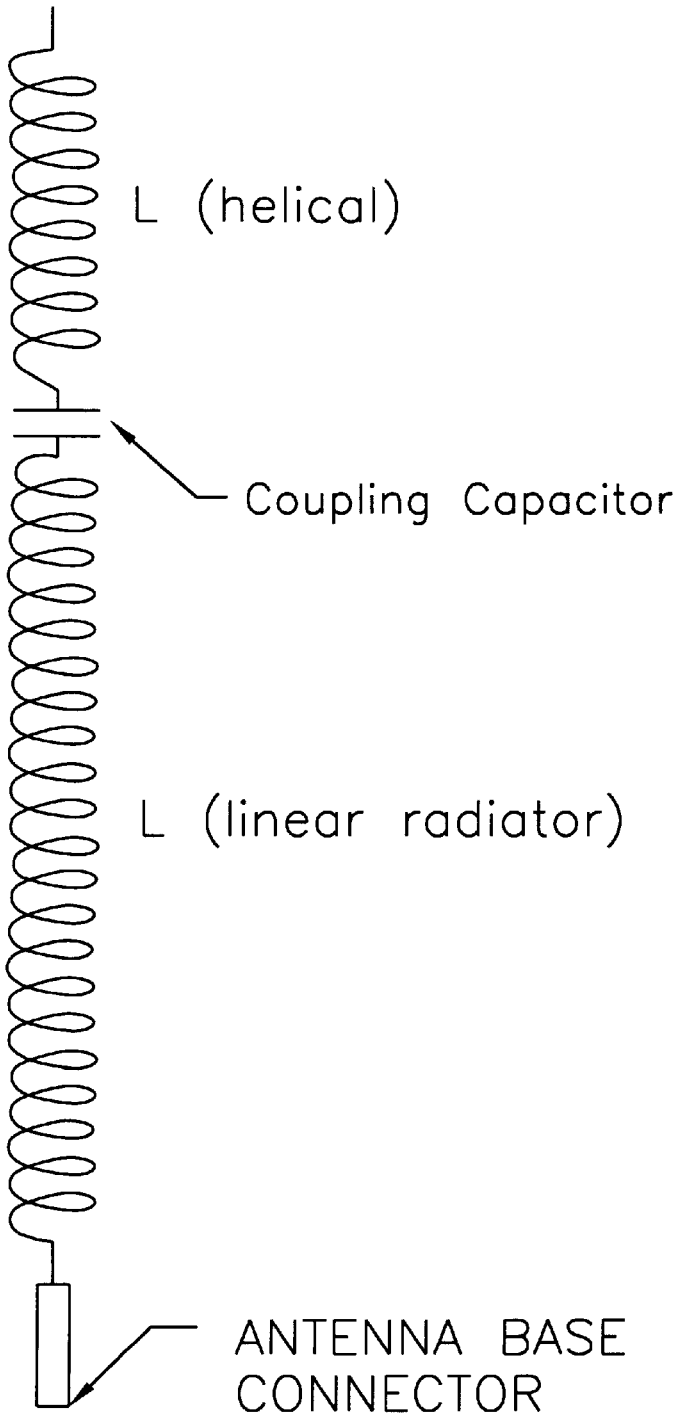
FIG. 4 is a simplified illustration of the general electrical equivalent circuit corresponding to the antenna of FIGS. 1–3.

Reference is now made to FIG. 4 which illustrates the general electrical equivalent circuit corresponding to the antenna of FIGS. 1A–3C. The inductances of the respective upper and lower radiating elements 24 and 20 are indicated as $L_{helical}$ and $L_{linear\ radiator}$ respectively.

Figure 5:
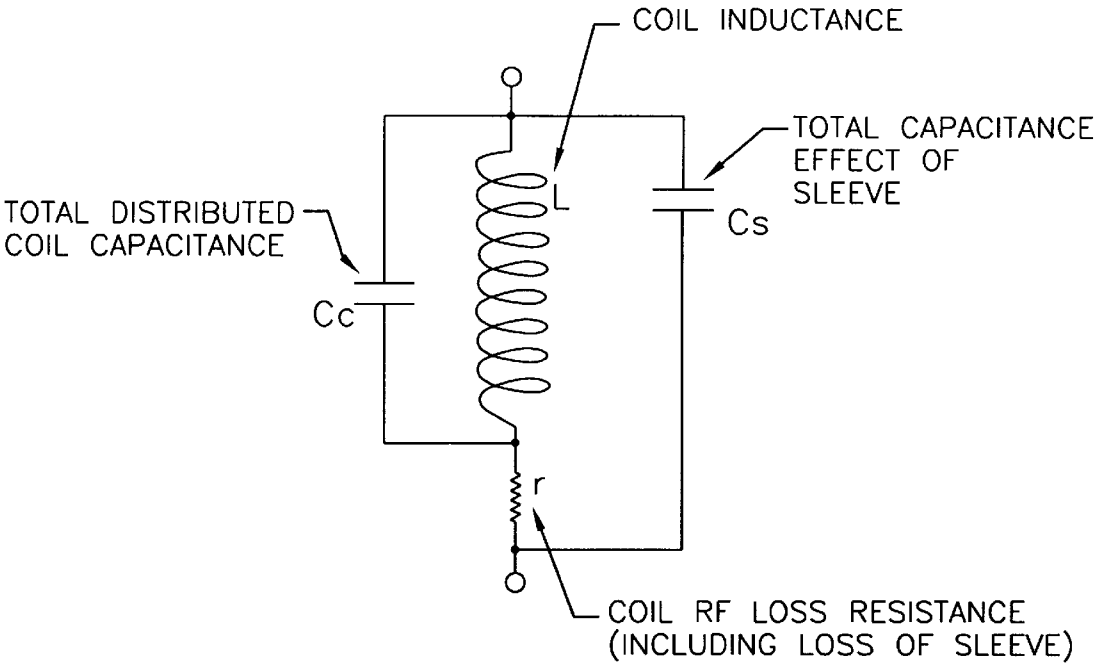
FIG. 5 is a simplified illustration of the electrical equivalent circuit of upper helical radiating element of the antenna of FIGS. 1–3.

Reference is now made to FIG. 5, which illustrates the electrical equivalent circuit of the upper radiating element 24 and its associated structure.

The capacitance of sleeve 28 is indicated as Cs, while the total distributed capacitance of the inductance associated with upper radiating element 24 is indicated as Cc. The loss resistance of the upper radiating element 24 is indicated as r and is typically negligibly small.

Accordingly, the coil parallel resonant frequency F is given by:

$$F = \frac{1}{2 * P * \sqrt{L * (Cs + Cc)}}$$

$$r \text{ negligible}$$

The circuit quality factor Q is given by:

$$Q = \frac{2 * P * F * L}{r}$$

The circuit dynamic impedance is:

$$Zd = \frac{L}{(Cs + Cc) * r}$$

Figure 6:
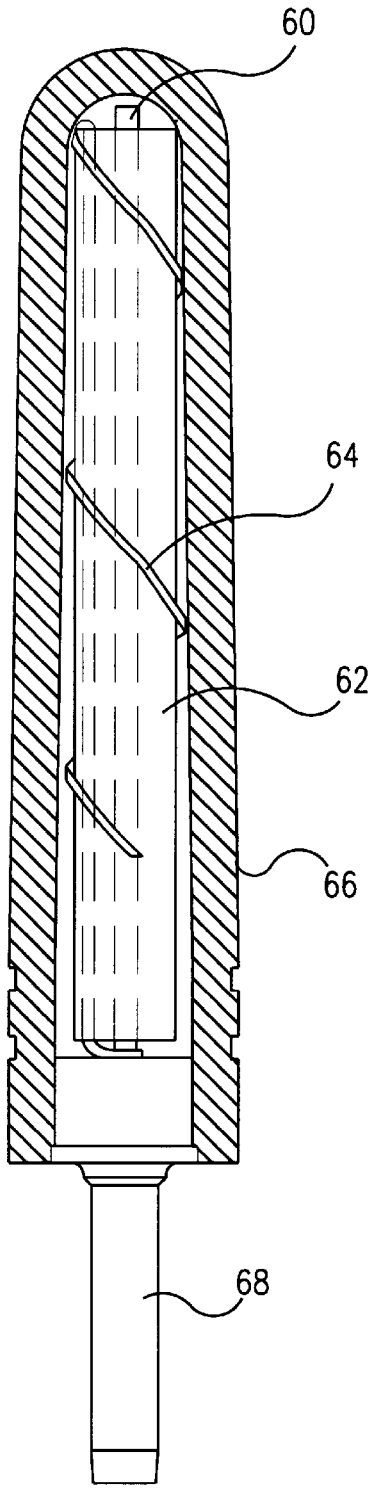
FIG. 6 is a simplified illustration of a dual mode antenna constructed and operative in accordance with another preferred embodiment of the present invention.

Reference is now made to FIG. 6, which is a simplified illustration of a dual mode helical antenna constructed and operative in accordance with another preferred embodiment of the present invention. This embodiment comprises a centrally positioned high frequency metallic radiating element 60 surrounded by a low-loss cellular dielectric support element 62.

Support element 62 supports a linear radiating element 64, typically in the form of a wire, which is wound over support element 62 and extends generally over the entire length of radiating element 60, thus defining an over-wound helical coil. The length of radiating element 64 is preferably such that it supports resonance at a lower frequency when surrounded by a low loss sleeve 66, as shown in FIG. 6. Radiating elements 60 and 64 are electrically connected to an RF connector 68.

Figure 7:
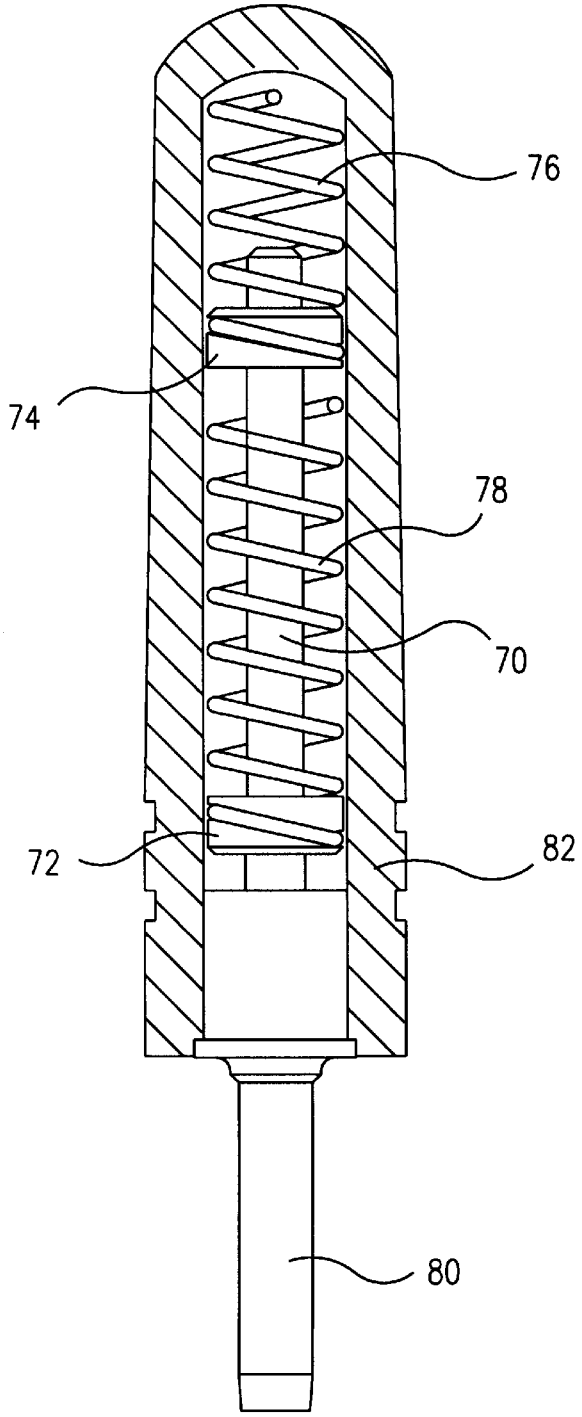
FIG. 7 is a simplified illustration of a dual mode antenna constructed and operative in accordance with yet another preferred embodiment of the present invention.

Reference is now made to FIG. 7, which is a simplified illustration of a dual mode antenna constructed and operative in accordance with yet another preferred embodiment of the present invention. This embodiment comprises a centrally positioned reduced length metallic resonator 70 which is fitted with two RF coil studs 72 and 74 onto which are mounted respective high frequency and lower frequency resonators 76 and 78. Stud 72 is electrically connected both to an RF connector 80 and to resonator 70. The above-described assembly preferably is surrounded by a low loss sleeve 82.

The position of RF coil stud 74 is critically dependent on the relative frequency values and the interaction, due to mutual inductance proximity effects, of the high and low frequency resonators 76 and 78. These interaction effects are modified by sleeve 82.

Figure 8:
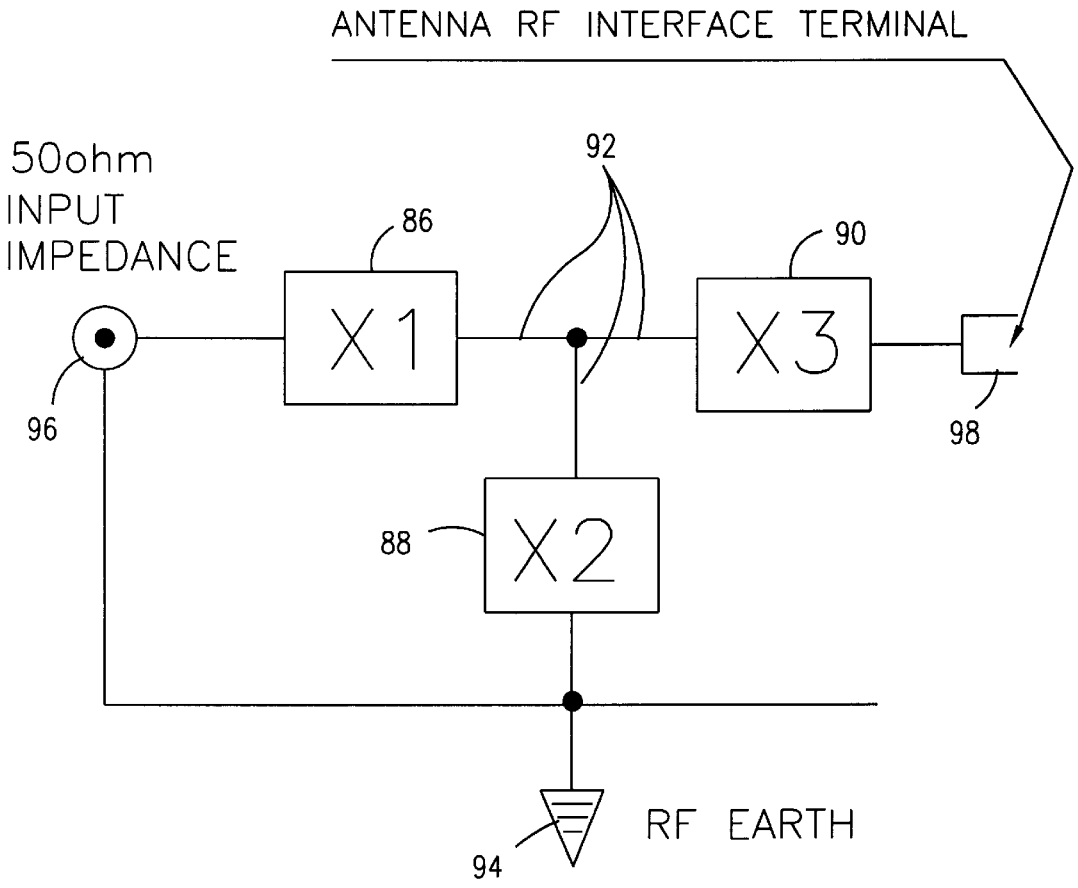
FIG. 8 is a simplified illustration of an antenna matching network useful with the antennas of FIGS. 1–7.

Reference is now made to FIG. 8, which is a simplified illustration of an antenna matching network 84, such as network 16 (FIG. 1A) useful with the antennas of FIGS. 1A–7. Network 84 typically comprises a combination of inductors and capacitors. In the preferred embodiment shown in FIG. 8, elements 86 and 88 are capacitors, and element 90 is an inductor. Capacitors 86 and 88 and inductor 90 are preferably interconnected via a conductive medium 92 which is connected to a ground 94 via capacitor 88. Preferably, a low impedance 96 is similarly interconnected, typically providing an impedance of 50 ohms. Network 84 interfaces with the antennas via an interface terminal 98, and is typically located below the antenna's base RF terminal, i.e. below the RF system ground-plane 18, although it may be located elsewhere provided that communication with the antenna is maintained.

The capacitance of capacitor 86 is preferably ten times that of capacitor 88, effectively providing an impedance step-up of ten times from the 50 ohm input coaxial terminal 96 to the junction 92 of the capacitors 86 and 88, and to the ground-plane 94 of the matching network 84.

The value of the inductance of inductor 90 is preferably chosen such that it:

forms a series-resonant circuit with capacitor 88, at the upper frequency design center of the chosen dual-band.

At RF input frequencies away from the center frequency, the series-resonant circuit acts as an effective capacitance for frequencies below the upper band design center (i.e. capacitive reactance >>inductive reactance) and an effective inductance for frequencies above the center frequency (i.e. capacitive reactance<< inductive reactance).

does not form a series resonant circuit with the capacitor 86, within either of the design frequency ranges specified, i.e. this series connected RF circuit (capacitor 86 and inductor 90) is therefore aperiodic for the specified dual frequency bands.

The RF path attenuation, through this series connected circuit (namely the capacitor 86 and the inductor 90) is very low and therefore this section of the matching network circuit 84 is "transparent" to signal frequencies below the upper frequency range specified.

provides reactance compensation (in association with the reactance/frequency variation of the other element of the matching network 84, namely capacitor 86) across the RF antenna terminal 17 to the ground plane 18, effectively changing an electrical length of the antenna 10 connected to the terminal 17. Ps If the reflected reactance effect, across this terminal, is negative, i.e. capacitive, then the effective electrical length of the antenna 10 is reduced (this implies optimum antenna operation at a higher frequency).

If this effect is positive, i.e. inductive, the effective electrical length of the antenna 10 is increased (implying antenna optimized performance at a lower frequency).

The antenna "base-loading" is, therefore, dependent on the frequency departure from the upper frequency design center value and the sign of the reflected reactive component. The greater this frequency departure the greater the reactance compensation and vice versa.

It is appreciated that other forms of impedance matching dual-frequency antennas are possible, such as broad-band impedance transformers having low distributed capacitance to ground. It is also appreciated that alternative methods of antenna matching known in the art may be used provided that appropriate reactance compensation is provided.

It will be appreciated by persons skilled in the art that the present invention is not limited to the specific examples shown and described herein, but extends to variations thereof as well as to all suitable combinations and subcombinations of features shown hereinabove.

We claim:

1. A broadband antenna, comprising:

a centrally-positioned radiating element;

a dielectric support element generally surrounding the centrally-positioned element; and a linear radiating element comprising an initial, generally straight, unwound portion which extends internally through said support element from a lower end of said support element to an upper end of said support element, and also comprising an external portion, extending from said unwound portion, which is wound over an external surface of said support element.

2. An antenna according to claim 1, wherein the centrally-positioned element comprises a linear metallic radiator.

3. An antenna according to claim 1, wherein the dielectric support element comprises a cellular material.

4. An antenna according to claim 1, and comprising an RF connector, which couples the centrally-positioned element and the linear radiating element commonly to an impedance-matching network.

5. An antenna according to claim 1, wherein the centrally-positioned element radiates primarily in a high-frequency band, and wherein the linear radiating element radiates in a low-frequency band.

6. An antenna according to claim 5, wherein the center frequencies of the high- and low-frequency bands are separated from each other by a frequency difference greater than half the center frequency of the low-frequency band.

7. An antenna according to claim 5, wherein the low-frequency band is in the AMPS range, and the high-frequency band is in the PCS range.

8. An antenna according to claim 5, wherein the low-frequency band is in the GSM range, and the high-frequency band is in the PCS range.

9. An antenna according to claim 5, wherein the low-frequency band is in the GSM range, and the high-frequency band is in the DCS range.

10. An antenna according to claim 5, wherein the low-frequency band is in the AMPS range, and the high-frequency band is in the DCS range.

* * * * *